United States Patent [19]

Girrell et al.

[11] Patent Number: 4,547,228

[45] Date of Patent: Oct. 15, 1985

[54] SURFACE TREATMENT OF METALS

[75] Inventors: Carol A. Girrell, North Brunswick; Joseph E. Japka, Cherry Hill, both of N.J.

[73] Assignee: Procedyne Corp., New Brunswick, N.J.

[21] Appl. No.: 498,327

[22] Filed: May 26, 1983

[51] Int. Cl.[4] ..... C23C 11/00

[52] U.S. Cl. ..... 148/16; 148/20.3

[58] Field of Search ..... 148/16, 20.3

[56] References Cited

U.S. PATENT DOCUMENTS

| | | | |
|---|---|---|---|
| 3,197,346 | 7/1965 | Munday | 148/16.5 |
| 3,658,602 | 4/1972 | Pomey | 148/14 |
| 3,663,315 | 5/1972 | Hoffman et al. | 148/16.6 |
| 4,236,942 | 12/1980 | Rudd et al. | 148/16.6 |
| 4,237,184 | 12/1980 | Gonseth | 148/16.6 |

*Primary Examiner*—Veronica O'Keefe

*Attorney, Agent, or Firm*—Kane, Dalsimer, Kane, Sullivan and Kurucz

[57] ABSTRACT

This application disclosed a method and apparatus for conducting various metal treatment processes including nitriding, carbonitriding, nitrocarburizing, surface activation, and selective oxidation in any desired sequence in the same fluidized bed furnace. The apparatus comprises a fluidized bed furnace having a humidifier system including a humidifier and superheater and the method involves exposing a metal workpiece sequentially to at least two separate metal treatment atmospheres in a fluidized bed furnace.

10 Claims, 2 Drawing Figures

SURFACE TREATMENT OF METALS

FIELD OF THE INVENTION

The present invention relates to metal treatment processes including carburizing, decarburizing, nitriding carbonitriding, nitrocarburizing, steam tempering, steam bluing, selective oxidation, and the like. More specifically, it relates to a method and apparatus for conducting various combinations of the foregoing processes sequentially in a single apparatus.

BACKGROUND OF THE INVENTION

Various metal treatment processes involving the exposure of metal workpieces, such as, tools and dies, cutting tools, castings, machined parts forgings and the like, to thermally controlled atmospheres having specific compositions that modify the chemistry of the workpiece and improve its physical properties, are well known. Illustrative examples of such processes include nitriding, carbonitriding, nitrocarburizing, and oxidation processes.

Nitriding processes typically involve exposing ferrous metal workpieces to heated ammonia derived atmospheres containing active nitrogen within a suitable furnace. The active nitrogen, usually derived from raw ammonia thermally decomposed within the furnace, diffuses into the workpieces' surface forming a nitrogen rich surface layer containing complex nitrides. See: U.S. Pat. No. 4,236,942.

Carbonitriding and nitrocarburizing typically involve ammonia derived atmospheres similar to nitriding except that the furnace atmosphere also contains active carbon that diffuses into the workpiece in addition to the nitrogen. See: U.S. Pat. No. 3,663,315.

Nitrided, carbonitrided and nitrocarburized workpieces display improved properties including greater hardness and enhanced wear, corrosion, and fatigue resistance making these processes useful in the production of metal cutting tools, machine parts, and the like.

The effectiveness of the foregoing processes is often diminished by prior processing steps that affect the workpiece surface, e.g. machining or polishing. Such surface processing may deactivate the surface to diffusion type metal treatments by producing surface oxides, surface carbides, deformations, or stresses that interfere with the diffusion of carbon and nitrogen. This shortcoming in the prior art can be overcome by the present invention preconditioning the workpiece in steam, air, humidified nitrogen, or humidified air atmospheres, as disclosed herein, to reactivate its surface so that treatment, e.g. nitriding, proceeds normally.

Another process according to the present invention for improving the corrosion resistance and wear characteristics, as well as, cosmetic appearance and ability to hold lubricant in metal workpieces is selective oxidation in wet or humidified atmospheres as hereinafter disclosed. Furthermore, this process is particularly useful for decreasing porosity and improving the compressive strength of powder and cast metals.

It is often desirable and sometimes required, to practice a combination of metal treatment processes on a single workpiece, e.g. preconditioning,—nitriding,—selective oxidation, to facilitate effective treatment and impart the improved physical properties that result from each process. Clearly, it would be advantageous to practice each process of such combinations in a single apparatus. Specifically, this would reduce handling of workpieces to be treated, reduce the process time and reduce energy and equipment requirements.

Heretofore, it has not been practical to carryout many different metal treatment processes in a single furnace because at least one of the chemicals used in one process is incompatible with those used in a second process, and so on. The incompatible chemicals may combine or otherwise react to form extremely corrosive, poisonous, or noxious products that damage the furnace and other equipment and or present health hazards. For example, it has heretofore been impractical to practice processes employing ammonia derived atmospheres and processes employing moisture bearing atmospheres in the same furnace because water vapor and ammonia form corrosive combinations that rapidly destroys the metal surfaces it contacts, e.g., the furnace retort. It has not proven economically feasible to purge or clean conventional furnaces between various incompatible processes since this entails a great deal of labor and down time for the apparatus.

SUMMARY OF THE INVENTION

The present invention comprises a method and apparatus whereby various metal treatment processes including nitriding, carbonitriding, nitrocarburizing, surface activation, and selective oxidation may be practiced in any sequence in the same fluidized bed furnace. That is to say processes employing various incompatible atmospheres may be practiced in the same fluidized bed e.g. processes that use water vapor containing atmospheres and ammonia derived atmospheres. The apparatus comprises a fluidized bed provided with a humidifying system that comprises a primary bath including a liquid filled insulated container, preferably provided with means for automatically maintaining the liquid level and a means for independently controlling the temperature therein, said container having an inlet whereby a carrier gas may be introduced to the liquid and an outlet whereby the carrier gas leaving the liquid exits the container, a first insulated conduit which leads the carrier gas from the outlet to a superheater whereby the temperature of the carrier gas and moisture picked up from the bath is elevated, as desired. A second insulated conduit leads the superheated carrier gas to the fluidized bed. The fluidized bed is further provided with a purge means for introducing an inert gas to the bed and a system of interlocks including high temperature interlocks, low temperature interlocks, and purge interlocks.

The method of the invention comprises the steps of exposing a metal workpiece to at least two separate metal treatment atmospheres in the same fluidized bed sequentially. In a preferred embodiment of the method of this invention at least one of the treatment atmospheres includes ammonia and at least one of the treatment atmospheres includes water, and more preferably, the water is introduced to the atmosphere with a humidifying system as disclosed herein.

DETAILED DESCRIPTION OF PREFERRED EMBODIMENTS

Figure 1:
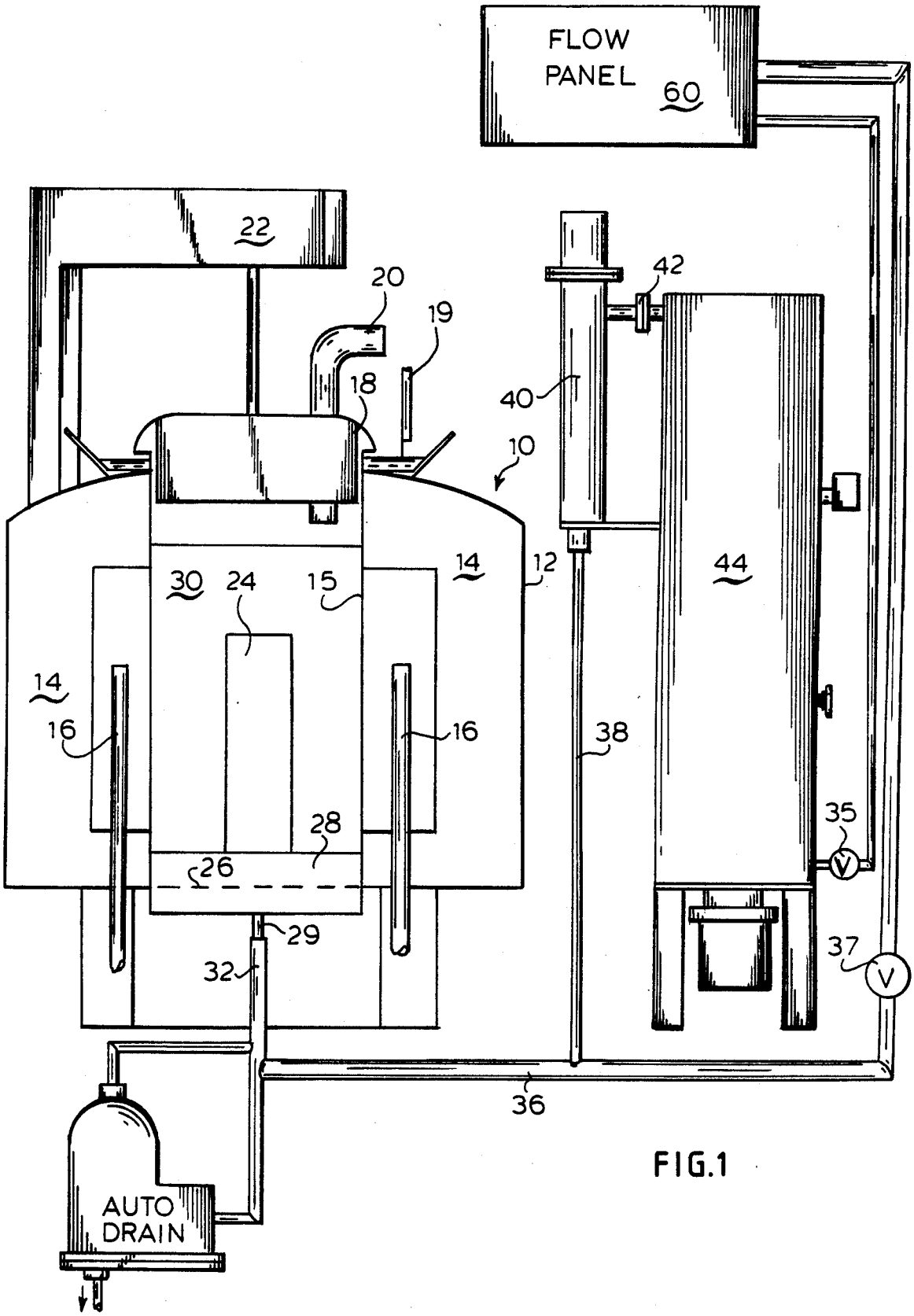
FIG. 1, is a cross-sectional schematic view of a fluidized bed equipped with a humidifier system in accordance with the present invention.

The fluidized bed type metal treatment furnace 10 shown in FIG. 1 comprises a rigid shell 12, preferably steel, lined with a heavy insulation 14 of ceramic fiber, or the like, that encloses heater elements or burners 16 which are in thermal communication with vertical retort 15, i.e. the treatment zone within the furnace. The upper end of the retort 15 may be sealed by removable insulated cover 18 which is provided with vent 20, or the like, that permits gases to escape from the retort 15 a pilot burner 18 may also be provided to burn of flamable fluidizing gas exhaust. Mechanism 22 opens and closes cover 18 facilitating insertion and removal of workpiece 24 or service operations. It will be appreciated that a variety of equivalent conventional methods and means for venting gases and opening and closing the cover exist including means for removing entrained solids from the off gases. The lower end of the retort 15 is defined by gas permeable distributor plate 26 thru which fluidizing and treatment gases enter the retort 15 causing particulate bed media 30 therein, e.g. 80 mesh or 120 mesh aluminum oxide particles or other inert solid material, to become suspended in the gases that are passing therethru at about 10–20 feet per minute or more vertically. The suspended bed media behaves like a liquid that hereinafter may be referred to as an 'expanded mass.' The fluidizing and treatment gases enter plenum 28 after passing the distributor plate 26 and into retort 15. The gases enter plenum 28 via plenum inlet 29 which is fed by conduit 32. Purge gases and treatment gases are fed to conduit 32 by supply conduit 36. Insulated conduit 38 feeds heated humidified gases from superheater 40 to conduit 36 for mixing with treatment gases and introduction into plenum 28. The flow in conduits 36 and 38 is regulated by valves 37 and 35 respectively. Humidified gas from humidifier 44 is introduced to the superheater 40 through conduit 42.

It will be appreciated that several piping configurations may accomplish the same objects as that described above and that various additional conduits, valves etc. may be added or eliminated depending on the specific intended process application and further that the insulation provided throughout the apparatus is intended to conserve heat and prevent undesirable condensation of gases and that insulation may be provided as desired in any known manner.

Figure 2:
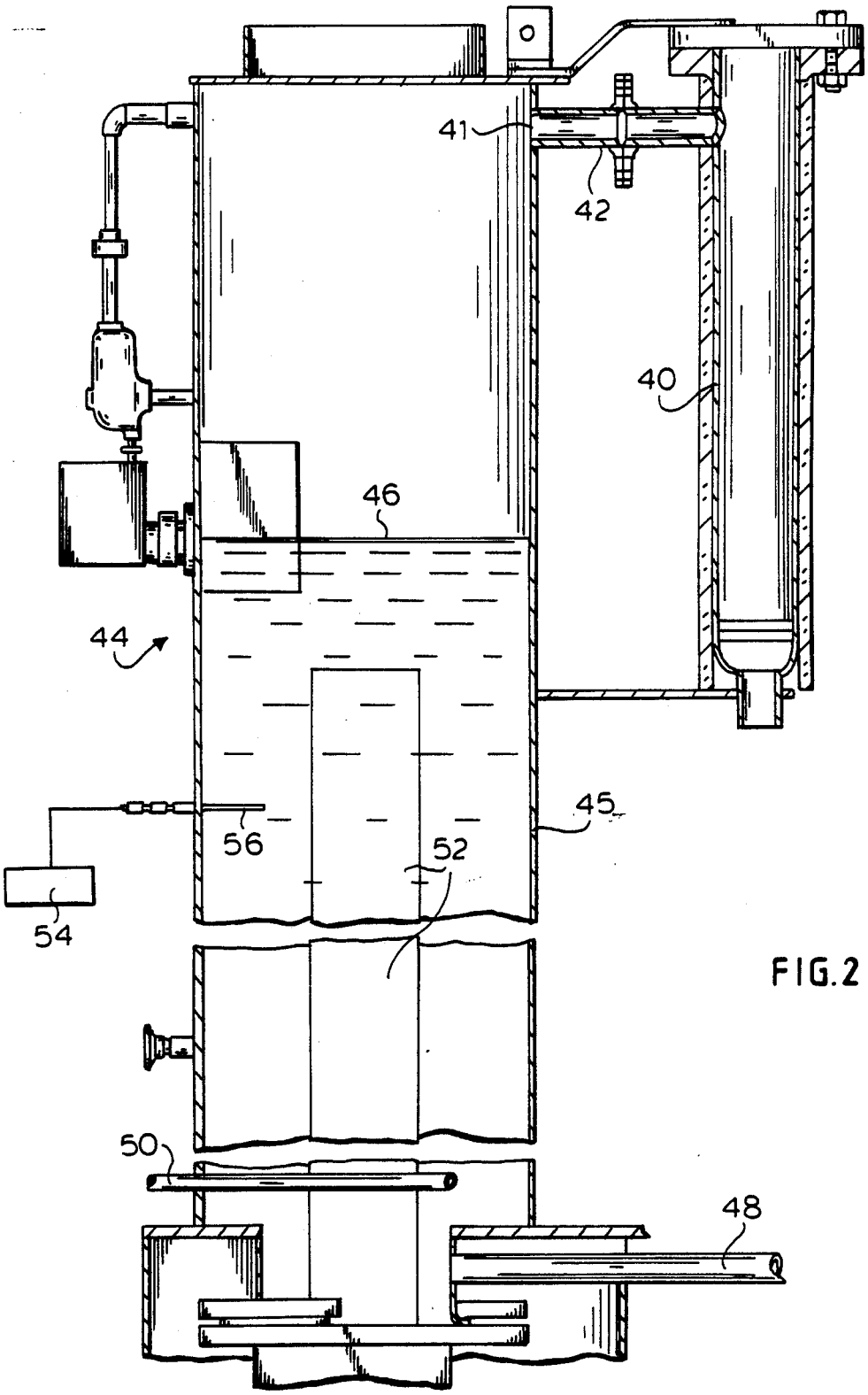
FIG. 2, is a cross-sectional view of the humidifier system shown in FIG. 1.

FIG. 2, is a more detailed view of the humidifier system which primarily comprises the humidifier 44, superheater 40 and conduits 38 and 42. The humidifier 44 comprises an insulated container 45 for liquid 46 usually water, having a carrier gas inlet 48 that feeds sparge means 50 that discharges the carrier gas into the liquid 46. A heater element 52 disposed in the liquid 46 is controlled by automatic temperature regulator 54 which is responsive to temperature sensor 56 and thus maintains the liquid at a desired temperature which may be monitored on thermometer 57. Humidified gas passes from the surface of the liquid thru outlet 41 into conduit 42 and then into superheater 40 wherein heater element 53 having its own temperature control (not shown) raises the temperature of the humidified gas to a desired temperature before it exits into insulated conduit 38. The flow of humidified gas thru insulated conduit 38 is regulated by valve 35 before entering conduit 36 wherein it may be mixed with metal treatment gas before entering plenum 28.

A typical example of a working embodiment of the present invention is the nitrocarburizing and steam blueing of high speed steel drill bits. The furnace is purged prior to loading with nitrogen, argon, or the like. The bits are placed in a basket, or the like, which is positioned in retort 15 instead of workpiece 24. Cover 18 is then closed. Nitrogen, argon, or the like continues to flow into plenum 28 and upwardly thru distributor plate 26 thereby fluidizing the bed media into an expanded mass and submerging the basket containing the drill bits therein. During temperature recovery, which is generally 10 to 60 minutes the inert gas continues to flow. The active gases can be introduced immediately however they are generally more costly than nitrogen. When the bed and parts are at the nitriding temperature, then ammonia plus natural gas for nitrocarburizing is introduced to the retort 15. (Typical nitrocarburizing temperatures are 900° to 115° F.) This is accomplished by adjusting valves arranged in flow panel 60 to change the gas composition from pure nitrogen to ammonia plus natural gas. It will be appreciated that other gases, e.g. nitrogen plus propane plus ammonia etc. or combinations thereof may be added to or substituted for the ammonia plus natural gas to change the treatment process as desired. In the present example the ammonia plus natural gas enters the heated retort 15 thru distributor plate 26 at a sufficient rate, e.g. 8 to 12 feet per minute vertically and more preferably 10 feet per minute to cause fluidization of the bed media while the active nitrogen and carbon derived therefrom diffuses into the drill bit surfaces forming a hardened case. This process step takes from 10 to 30 minutes. Then humidified nitrogen is introduced to the retort 15 to partially oxidize the surface of the drill bits by opening valve 35 and adjusting valves in flow panel 60. The humidified nitrogen is prepared by passing nitrogen gas into the humidifier 44 via inlet 48 so that it is sparged into the heated water therein. The nitrogen bubbles thru the water bath 46 which is maintained at a temperature between 115° and 200° F. by heater means 52, 54, and 56 and thereby takes up moisture. The moist, i.e. humidified nitrogen then passes to superheater 40 which further raises its temperature to between 450° and 550° F. so that as temperature is lost in conduit 36, there is no loss of humidity by condensation. The humidified nitrogen then passes via the provided conduits into the plenum 28 and upwardly into retort 15 where it partially oxidizes the surface of the drill bits rendering them more corrosion resistant, scuff-resistant and better able to hold lubricant. In addition to the improved operational properties, the bits take on an attractive uniform color. The type of oxide and therefore the color formed may be varied in accordance with the type of humidified gas employed, e.g. air, nitrogen, argon, helium, or like gases, and mixtures thereof; or varying the temperature of the humidifier bath 46, or the temperature of the retort 15. Typically these selective oxide processes sometimes referred to as steam bluing treatments take from 15 to 45 minutes depending on the temperature and gases used. The drill bits treated in accordance with the foregoing process may then be removed from the retort 15 and quenched, e.g. in an oil bath if additional corrosion resistance, lubricity and/or darker color, are desired.

In another embodiment the beneficial effects of oxidizing and nitriding, i.e. oxynitriding, can be achieved simultaneously by introducing ammonia and humidified gas to the retort at the same time to create an oxynitriding metal treatment atmosphere. It will be appreciated that the humidified gases contemplated by the present invention may be used in combination with various metal treatment atmospheres to achieve improved or modified results.

A similar example of the present invention is preconditioning of a deactivated surface such as one that was polished, machined, or oxidized for making it receptive to diffusion of active nitrogen or carbon therethru. The retort 15 is purged and the workpiece is placed therein as in the preceding example. The retort 15 is then closed and fluidized with humidified nitrogen or humidified air or mixtures of activating gases like humidified nitrogen plus hydrogen. The retort is again purged with nitrogen (if humidified air was used) and thereafter raw ammonia is introduced to nitride the workpiece as hereinabove described. This process permits surfaces that have been deactivated to nitriding by oxides, deformation, stress, or the like to be successfully nitrided and in most instances with better results than otherwise expected.

In the foregoing examples, the workpiece is not removed from the retort 15 between the metal treatment processes, i.e. changes of the treatment atmosphere, resulting in substantial savings of time and labor. Furthermore, in these examples treatment with a humidified (wet) gas is preceded or followed by treatment with ammonia, or combinations of ammonia and other gases, which would not be possible in conventional furnaces within the given time parameters without damage to the retort from the corrosive water/ammonia mixtures.

This invention is also useful in oxynitriding processes, wherein the workpiece surface becomes a mixture of oxides and nitrides that is desirable for certain applications. Temperatures for these processes are in the range of 950° to 1100° F. and water is the preferred atmosphere component for the oxidation. However, as described above, the water forms an unacceptably corrosive mixture with the ammonia required for nitriding. Consequently, conventional oxynitriding techniques have been limited, by practicality, to oxygen and carbon dioxide for the oxydizing atmosphere component and since dry oxygen is difficult to obtain and is costly, carbon dioxide has become commercially preferred. Carbon dioxide and oxygen derived atmospheres are much slower acting and less efficient than steam derived atmospheres and often cause at least some undesirable decarburization of the workpiece.

In the present invention the humidified gases may be introduced to the retort at the same time as ammonia without appreciable corrosion problems associated with ammonia/water mixtures. Naturally, all the metal treatment processes performed in the apparatus of this invention are benefited by the high heat transfer rates, thermal uniformity, efficiency, and ease of operation associated with the fluidized beds. These features result in reduced process cycle times better products and safer operation.

What is claimed is:

1. A method for treating metals, which comprises the steps of:

providing a fluidized bed;

placing a metal workpiece in the fluidized bed;

sequentially exposing the metal workpiece to at least two separate metal treatment atmospheres in the same fluidized bed at least one of said atmospheres being humidified for surface treatment of the metal workpieces to modify the chemistry of the surface of the workpiece.

2. The method of claim 1, wherein at least one of the metal treatment atmospheres contains ammonia; and at least one of the metal treatment atmospheres contains water.

3. The method recited in claim 2 wherein the water is added to the metal treatment atmosphere by means of a humidified gas.

4. The method recited in claim 3, wherein the gas is humidified by sparging it through heated water.

5. The method recited in claim 4 further comprising the step of superheating the humidified gas before introducing it to the metal treatment atmosphere.

6. A method for oxynitriding metals comprising the steps of:

placing a metal workpiece in a heated fluidized bed; and passing a mixture of gases containing ammonia and a humidified inert gas through the fluidized bed for surface treatment of the metal workpieces to modify the chemistry of the surface of the workpiece.

7. A method for preconditioning metal workpieces for nitriding, which comprises: placing a metal workpiece in a fluidized bed; heating the fluidized bed and passing a humidified gas through the fluidized bed for surface treatment of the metal workpieces to modify the chemistry of the surface of the workpiece.

8. The method recited in claim 7 wherein the humidified gas is an inert gas.

9. A metal treatment process which comprises:

exposing a metal workpiece to a metal treatment atmosphere including a humidified gas and a hydrocarbon bearing gas in a fluidized bed for surface treatment of the metal workpieces to modify the chemistry of the surface of the workpiece.

10. The method recited in claim 1, wherein one of the metal treatment atmospheres is a hydrocarbon bearing gas.

* * * * *